US006207884B1

(12) United States Patent
Hsieh

(10) Patent No.: US 6,207,884 B1
(45) Date of Patent: Mar. 27, 2001

(54) FRENCH HORN

(76) Inventor: Wu-Hong Hsieh, No. 162, Chung Shan 2nd Rd., Lu Chou City, Taipei Hsien (TW)

( * ) Notice: Subject to any disclaimer, the term of this patent is extended or adjusted under 35 U.S.C. 154(b) by 0 days.

(21) Appl. No.: 09/498,227

(22) Filed: Feb. 3, 2000

(51) Int. Cl.[7] ..... G10D 7/10
(52) U.S. Cl. ..... 84/387 R; 84/391; 84/392
(58) Field of Search ..... 84/387 R, 391, 84/392, 393, 394, 398, 399

(56) References Cited

U.S. PATENT DOCUMENTS

| | | | | |
|---|---|---|---|---|
| 3,933,078 | * | 1/1976 | Veneklasem | 84/387 |
| 3,938,419 | * | 2/1976 | DeRosa | 84/1.14 |
| 4,083,287 | * | 4/1978 | Suzuki | 84/377 |
| 4,993,303 | * | 2/1991 | Clark | 84/394 |
| 5,076,130 | * | 12/1991 | Nicolai | 84/389 |

* cited by examiner

*Primary Examiner*—Robert E. Nappi
*Assistant Examiner*—Kim Lockett
(74) *Attorney, Agent, or Firm*—Alan Kamrath; Rider Bennett Egan & Arundel, LLP.

(57) ABSTRACT

An improved French horn includes a coiled tubular body having a bell end, a curved inlet end and a plurality of valves formed thereon between the bell end and the inlet end for controlling a flow of air through the French horn. A mouthpipe has a mouthpiece end, a curved outlet end and a substantially straight section between the mouthpiece end and the outlet end. A pipe detachably interconnects the inlet end of the coiled tubular body and the outlet end of the mouthpipe. The pipe is configured so that the interconnected mouthpipe may be situated at either one of two positions relative to the body, including a first position in which the substantially straight section of the mouthpipe is substantially tangential to the coiled tubular body, and a second position in which the substantially straight section of the mouthpipe is away from the first position and close to the valves of the coiled tubular body.

7 Claims, 5 Drawing Sheets

FRENCH HORN

BACKGROUND OF THE INVENTION

1. Field of the Invention

The present invention relates to a French horn and, more particularly, to an improved French horn which is adjustable to be played by either an adult or a child.

2. Description of Related Art

The French horn, one of the brass wind instruments, is popular for its favorable and resounding tone that it produces. As shown in FIG. 5, such a conventional horn typically includes a mouthpipe (90) fixedly connected to a coiled tubular body (92) with a plurality of keys (94) arranged at a side of valves (96) for controlling a flow of air through the horn. Because neither the mouthpipe (90) nor the keys (94) are adjustable in their positions relative to the coiled tubular body (92), it is difficult for a child to play the conventional horn.

Therefore, it is an objective of the invention to provide an improved French horn to mitigate and/or obviate the aforementioned problems.

SUMMARY OF THE INVENTION

The object of the present invention is to provide an improved French horn which is adjustable to be played by either an adult or a child.

Another object of the present invention is to provide an improved French horn which has a thumb hook, a little finger hook and a forefinger rest, each being adjustable to the left hand of a user who holds the French horn mainly with the left hand.

Other objects, advantages and novel features of the invention will become more apparent from the following detailed description when taken in conjunction with the accompanying drawings.

DETAILED DESCRIPTION OF THE PREFERRED EMBODIMENT

Figure 1:
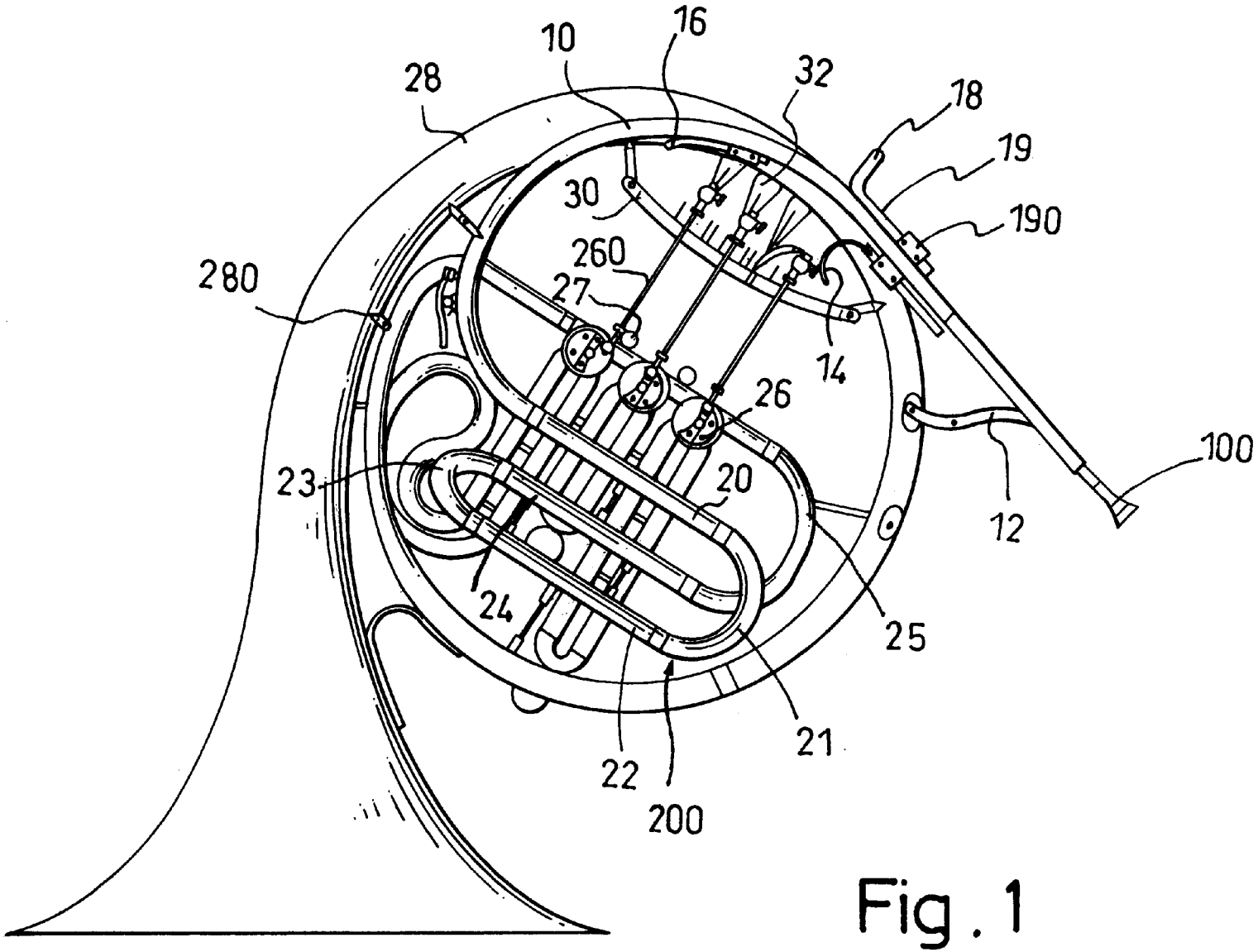
FIG. 1 is a view showing a preferred embodiment of an improved French horn in accordance with the present invention configured into a first mode for being played by an adult.
Figure 2:
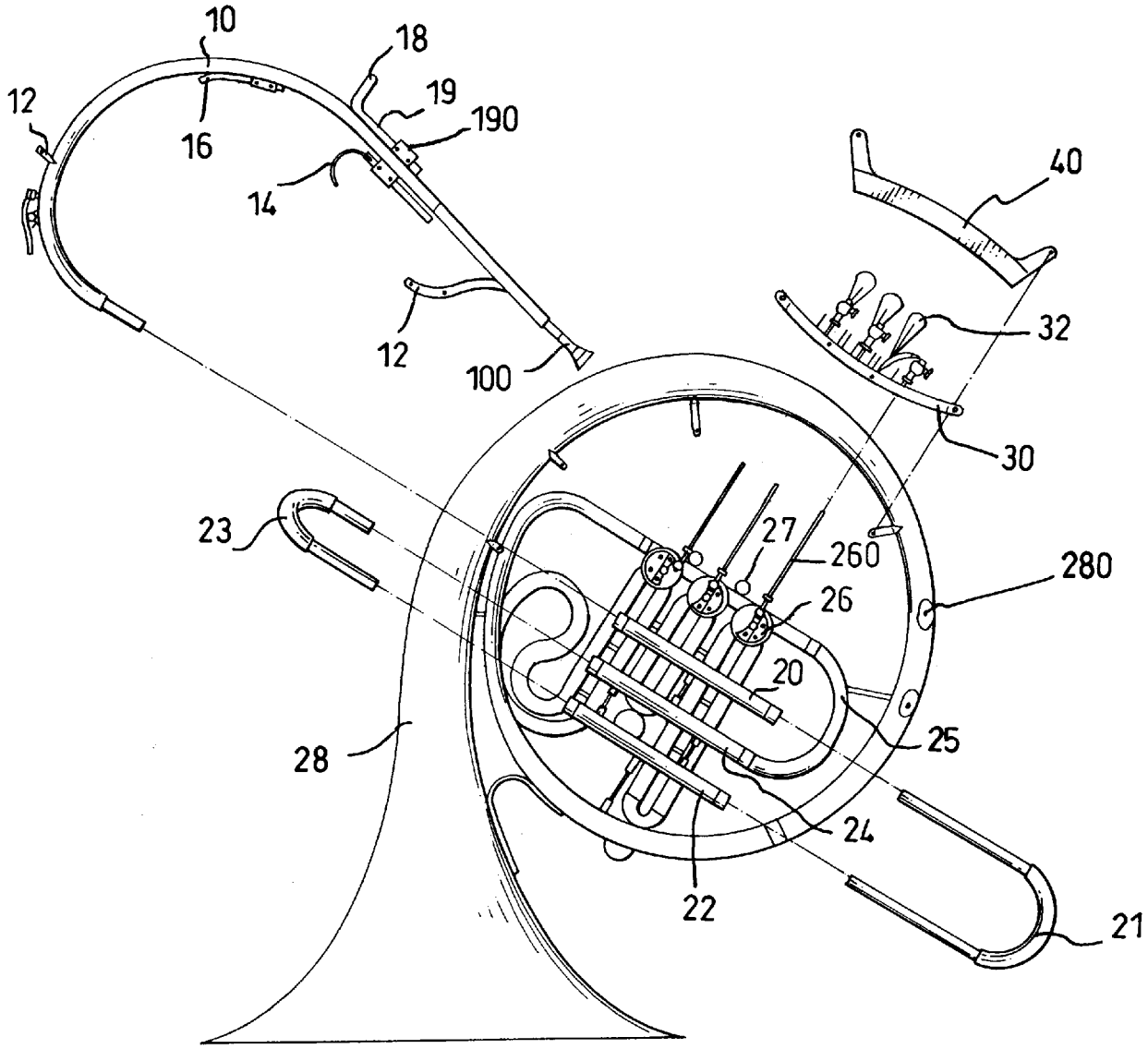
FIG. 2 is an exploded view of the improved French horn shown in FIG. 1.

FIGS. 1 and 2 show a preferred embodiment of an improved French horn in accordance with the present invention configured in a first mode for being played by an adult. The inventive French horn includes a coiled tubular body (28) having a bell end (not numbered) and a curved inlet end (25), a mouthpipe (10) having a mouthpiece end (100) and a curved outlet end (not numbered), and a pipe (200) detachably interconnecting the inlet end (25) of the coiled tubular body (28) and the outlet end of the mouthpipe (10);

The pipe (200) preferably includes first, second and third parallel tubes (20, 22, 24), with the first and second ones (20, 22) symmetrical about the third one (24). The parallel tubes (20, 22, 24) each have a first end and a second end: a first U-bend (21) interconnects the first ends of the first and second tubes (20, 22), and the coiled tubular body (28) is connected at its curved inlet end (25) to the first end of the third tube (24).

In this first configuration, a second U-bend (23) detachably interconnects the second ends of the second and third tubes (22, 24), and the mouthpipe (10) is detachably connected at its curved outlet end to the second end of the first tube (20).

In such a manner, air blown into the mouthpipe (10) from its mouthpiece end (100) can flow through the first tube (20), the first U-bend (21), the second tube (22), the second U-bend (23), the third tube (24) and the coiled tubular body (28) subsequently and is finally discharged from the French horn, via the bell end of the body (28).

It is important that the tubes (20, 22, 24) must be arranged in such a way that the mouthpipe (10) may be situated, relative to the body (28), at a normal position in which a substantially straight section of the mouthpipe (10) is substantially tangential to the coiled tubular body (28) when the mouthpipe (10) is connected at its curved outlet end to the second end of the first tube (20), i.e. the French horn is configured in the first mode, as best shown in FIG. 1.

The mouthpipe (10) can be held in this normal position by a plurality of braces (12) that extend from the mouthpipe (10) and are fixed to brace flanges (280) formed on the coiled tubular body (28).

As clearly shown in FIG. 1, the coiled tubular body (28) has a plurality of valves (26) formed thereon between its bell end and curved inlet end (25) for controlling the flow of air through the inventive French born, while a carrier (30) is provided with a plurality of keys (32) to control the valves (26), through respective linking rods (260) that interconnect the keys (32) and the valves (26). In the first mode, the carrier (30) is detachably attached to the coiled tubular body (28) at a location where the substantially straight section of the mouthpipe (10) is tangential to the body (28).

As best shown in FIG. 2, the mouthpipe (10) is formed with a thumb hook (14), a little finger hook (16) and a forefinger rest (18), each having an integral stem (19) adjustable in an axial direction along and lockable with a holder (190) through which the stem (19) extends.

The carrier (30), the hooks (14, 16) and the rest (18) are arranged so that an adult player (not shown) may hold the tangential portions of the tubular body (28) and the alongside mouthpipe (10) with his left hand, with his thumb and little finger engaged with the hooks (14, 16), and his remaining fingers extending around the tangential portions to press the keys (32) formed on the carrier (30).

Figure 3:
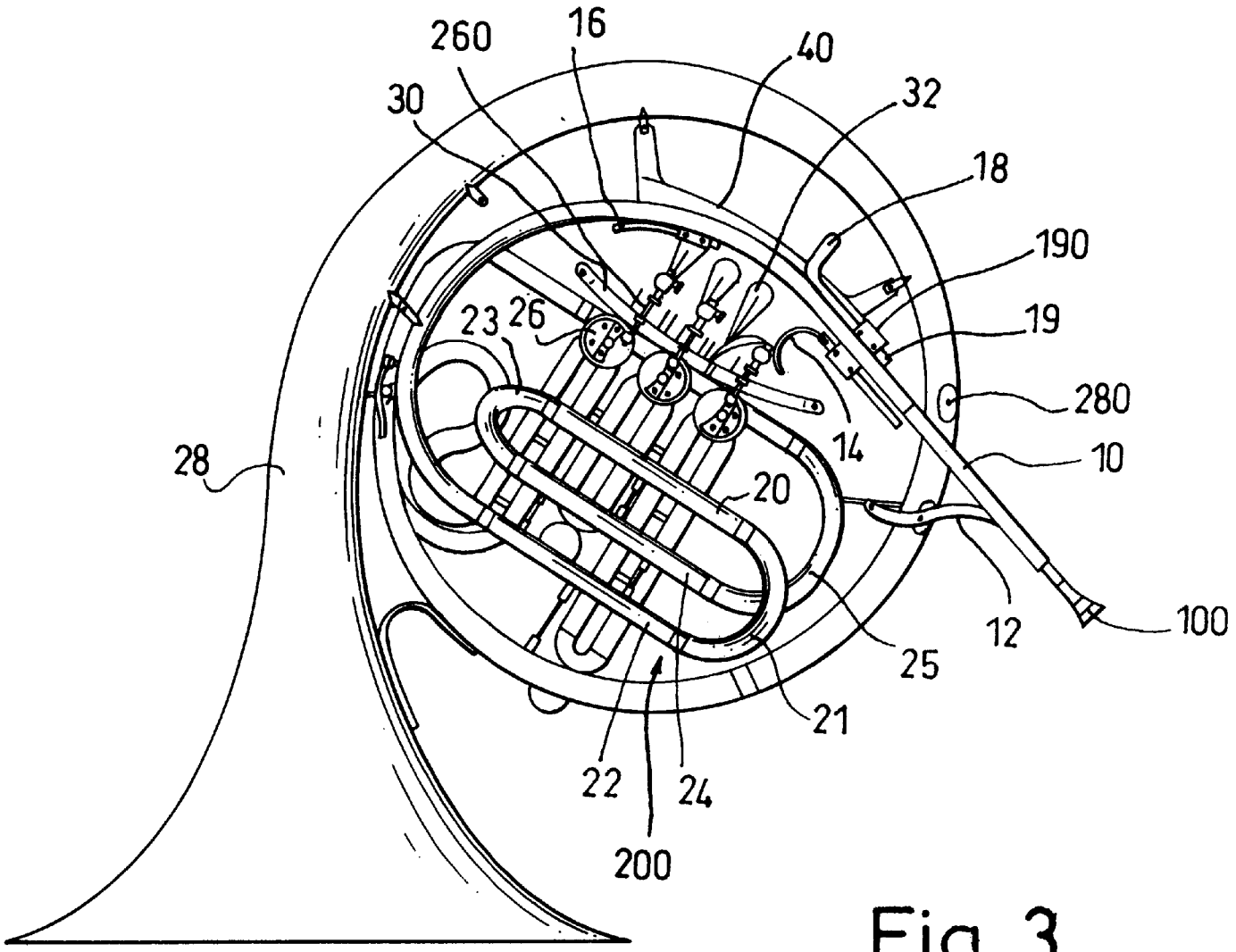
FIG. 3 is a view showing the improved French horn of FIG. 1 configured into a second mode for being played by a child.

FIG. 3 shows the inventive French horn constructed in accordance with the present invention configured in a second mode for being played by a child.

This second configuration can be achieved simply by removing the mouthpipe (10) from the first tube (20) and the second U-bend (23) from the second and third tubes (22, 24), as shown in FIG. 2. The second U-bend (23) is then repositioned to detachably interconnect the second ends of first and second tubes (20, 22), and the mouthpipe (10) is detachably reconnected at its curved outlet end to the second end of the second tube (22), thereby enabling the substantially straight section of the mouthpipe (10) to be away from its tangential position and near the valves (26) of the coiled tubular body (28) without changing the whole length of the French horn, as clearly shown in FIG. 3.

The mouthpipe (10) is held in the new position by the braces (12) that are now fixed to brace flanges (280) different from those as in the first mode.

Simultaneous with the repositioning of the mouthpipe (10), the carrier (30) is moved from the location shown in FIG. 1 to a location shown in FIG. 3, and more precisely, the carrier (30) is removed from the coiled tubular body (28) and is detachably attached to a seat (27) formed on the coiled tubular body (28) and adjacent to the valves (26). At the same time, the original linking rods (260) are replaced by substitute rods (260') of an appropriate length to interconnect the keys (32) and the valves (26).

Figure 4:
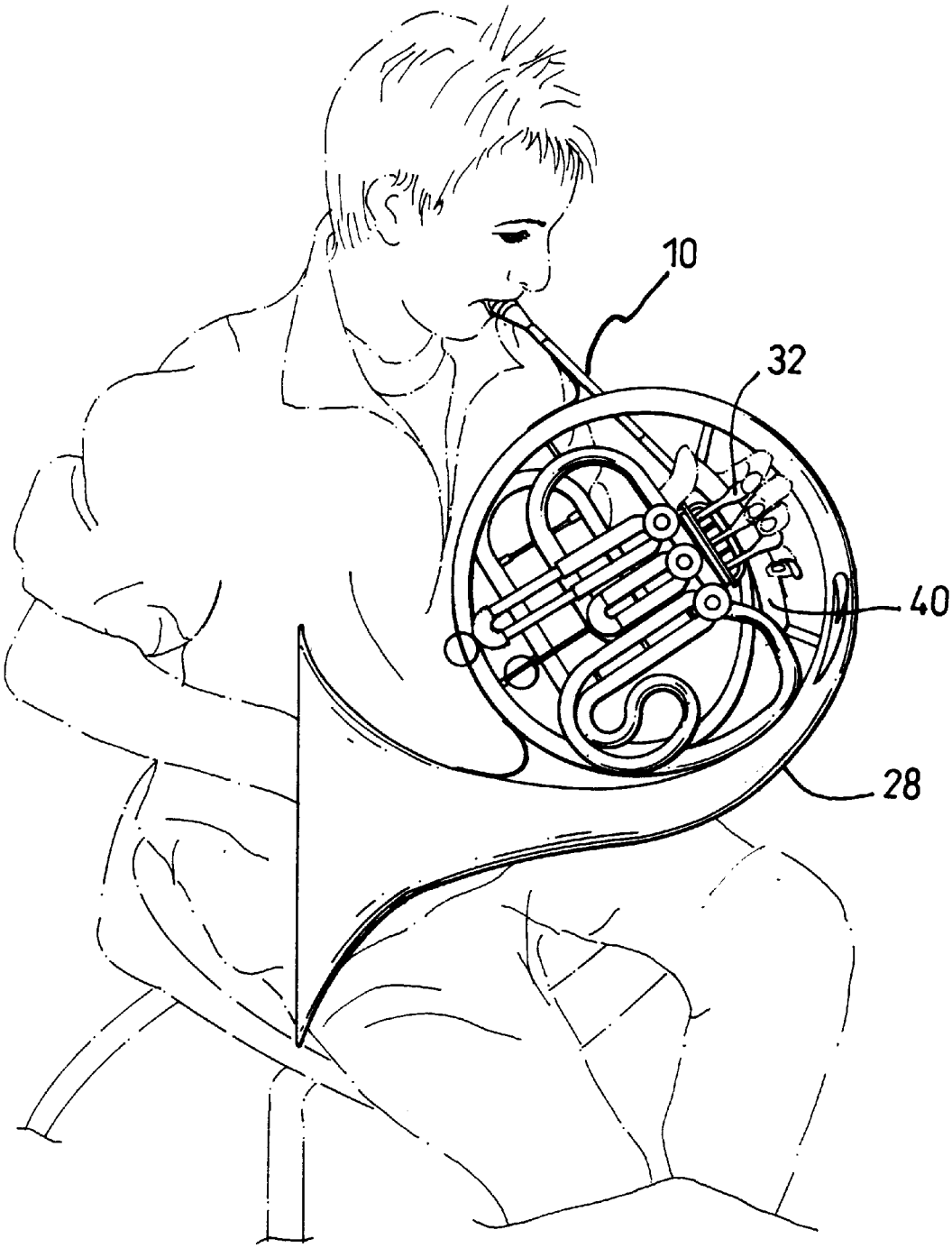
FIG. 4 is a schematic view of a child playing the improved French horn configured into the mode as shown in FIG. 3.
Figure 5:
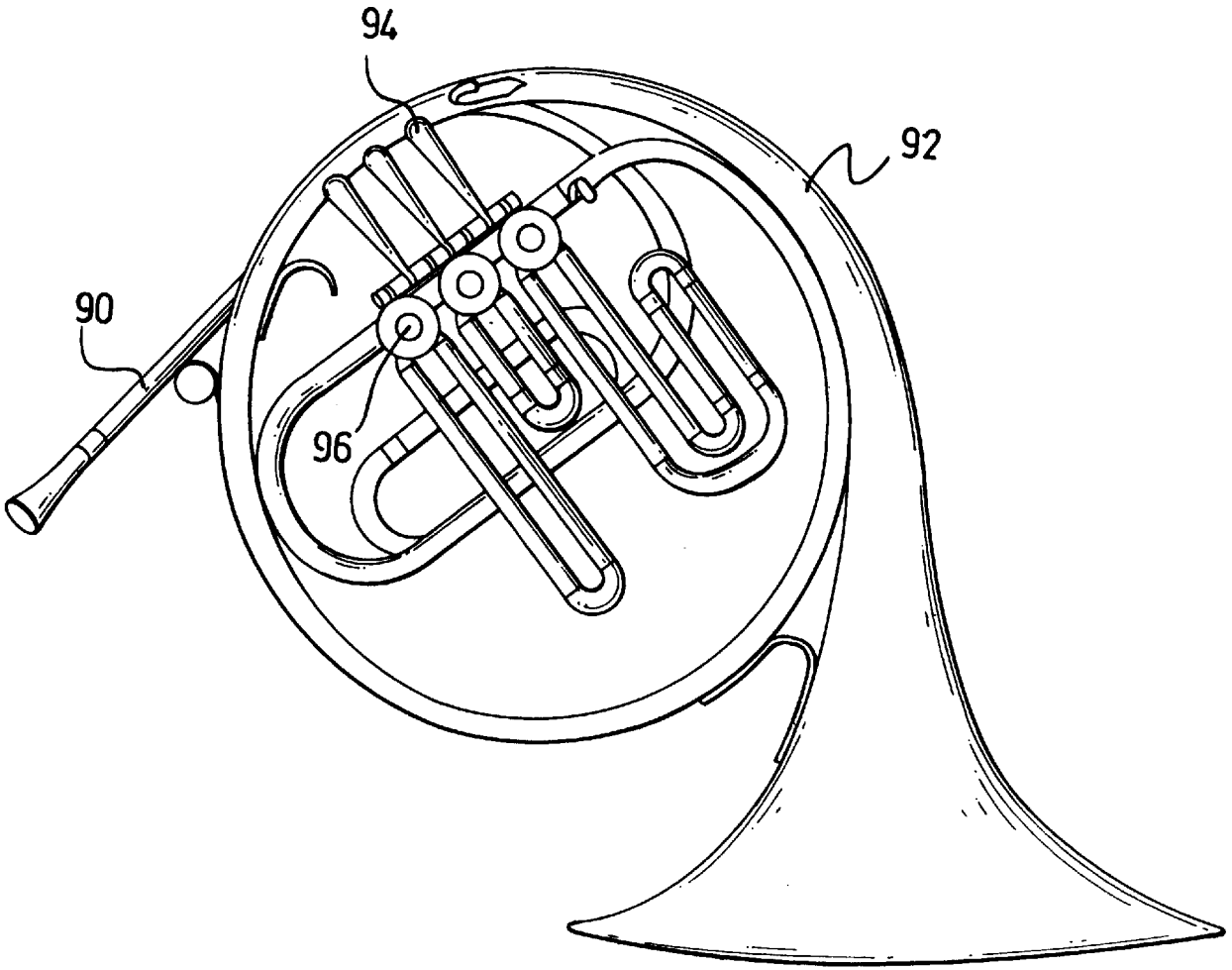
FIG. 5 is a view of a conventional French horn.

In this second mode, it is more preferable that a handle (40) is additionally attached to the coiled tubular body (28) so as to extend alongside the mouthpipe (10), thereby enabling a child to hold the French horn at the handle (40) and the alongside mouthpipe (10) with his left hand to play the horn easily, as shown in FIG. 4.

From the above description, it is noted that the invention has the following advantages:

1. adaptability:

Because the inventive French horn can be configured in two modes, it can be played by either an adult or a child after only a simple adjustment;

2. comfort in holding the horn:

Because there is provided the adjustable forefinger rest (18) in addition to the thumb hook (14) and the little finger hook (16), which are also adjustable, it is comfortable for the player, either an adult or a child, to hold the horn.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A French horn comprising:

a coiled tubular body (28) having a bell end, a curved inlet end (25) and a plurality of valves (26) formed between said bell end and said inlet end (25) for controlling a flow of air through said French horn;

a mouthpipe (10) having a mouthpiece end (100), a curved outlet end and a substantially straight section between said mouthpiece end (100) and said outlet end;

a pipe (200) detachably interconnecting said inlet end of said coiled tubular body (28) and said outlet end of said mouthpipe (10);

wherein said pipe (200) is so configured that said mouthpipe (10) when interconnected is interchangeably situated at two positions relative to said body (28), wherein the two positions including a first position in which said substantially straight section of said mouthpipe (10) is substantially tangential to said coiled tubular body (28), and a second position in which said substantially straight section of said mouthpipe (10) is away from said first position and close to said valves (26) of said coiled tubular body (28).

2. The improved French horn as claimed in claim 1, wherein said pipe (200) for interconnecting comprises:

first, second and third parallel tubes (20, 22, 24) each having a first end and a second end, said first and second tubes (20, 22) being arranged symmetrically about said third tube (24);

a first U-bend (21) interconnecting said first ends of said first and second tubes (20, 22);

said coiled tubular body (28) being connected at said curved inlet end (25) to said first end of said third tube (24);

a second U-bend (23) detachably interconnecting said second end of said third tube (24) and either one of said second ends of said first and second tubes (20, 22);

said mouthpipe (10) being detachably connected at said curved outlet end to the other one of said second ends of said first and second tubes (20, 22); and wherein said tubes (20, 22, 24) are arranged so that said mouthpipe (10) is situated in said first position when said mouthpipe (10) is connected at said curved outlet end to said second end of said first tube (20) and in said second position when said mouthpipe (10) is connected at said curved outlet end to said second end of said second tube (22).

3. The improved French horn as claimed in claim 1 further including a carrier (30) formed with a plurality of keys (32) for controlling said valves (26) of said coiled tubular body (28).

4. The improved French horn as claimed in claim 3, wherein said carrier (30) is positioned at either one of two locations, comprising a first location adjacent to said coiled tubular body (28) when said mouthpipe (10) is in said first position, and a second location adjacent to said valves (26) of said body (28) when said mouthpipe (10) is in said second position.

5. The improved French horn as claimed in claim 1, wherein said mouthpipe (10) has a thumb hook (14), a little finger hook (16) and a forefinger rest (18) formed thereon.

6. The improved French horn as claimed in claim 5, wherein said hooks (14, 16) and said rest (18) are adjustable in positions relative to said mouthpipe (10).

7. The improved French horn as claimed in claim 1 further including a handle (40) adapted to extend alongside said mouthpipe (10) when said mouth pipe (10) is in said second position.

* * * * *